US005967418A

United States Patent [19]

MacDonald et al.

[11] Patent Number: 5,967,418

[45] Date of Patent: Oct. 19, 1999

[54] SPRAY BAR FOR USE WITH WEBS OF DIFFERENT WIDTHS

[76] Inventors: Robert W. MacDonald, 255 West La., Ridgefield, Conn. 06877; Victor Szatkowski, 473 Golf Rd., Orange, Conn. 06477

[21] Appl. No.: 08/885,649

[22] Filed: Jun. 13, 1997

[51] Int. Cl.[6] ..... A62C 31/02

[52] U.S. Cl. ..... 239/391; 239/550; 239/562

[58] Field of Search ..... 239/170, 436, 239/437, 438, 550, 562, 566, 395, 391; 101/147, 148

[56] References Cited

U.S. PATENT DOCUMENTS 3,924,531 12/1975 Klinger ..... 101/142
4,747,541 5/1988 Morine et al. ..... 239/127
4,930,706 6/1990 Merlin ..... 239/724
5,025,722 6/1991 Switall et al. ..... 101/147

*Primary Examiner*—Andres Kashnikow
*Assistant Examiner*—Jorge Bocanegra
*Attorney, Agent, or Firm*—Morgan & Finnegan, LLP

[57] ABSTRACT

A spray bar for use with a first web having a first width and a second web having a second width comprises a spray bar mounting channel having at least one cut-out in a front surface thereof. A plurality of reduction plates are affixed to the mounting channel over the cut-out. In one embodiment, each reduction plate has a center line and an opening therethrough located a predetermined offset from the center line.

24 Claims, 4 Drawing Sheets

SPRAY BAR FOR USE WITH WEBS OF DIFFERENT WIDTHS

BACKGROUND OF THE INVENTION

1. Field of the Invention

This invention relates generally to a spray dampening system for use with webs of varying sizes.

2. Description of Related Art

It is well known that the printing plate of a printing press is chemically treated so that only the printing area is receptive to ink. The non-printing area, on the other hand, is hydrophilic and receptive only to a dampening fluid, such as water. When the dampening fluid is applied to the plate, the water beads up on the printing area and is retained by the non-printing area. Consequently, the dampening water retained by the non-printing area creates a film barrier between the inking rollers and the non-printing area while the printing area, with no film of dampening water, accepts the ink. The ink is then transferred from the printing area of the plate and eventually to the paper web. The dampening water also serves to keep the rollers of the press lubricated. The dampening water can be applied by a variety of dampening water supply systems. One such system, spray bar dampening systems, is well known in the art.

In general, in a spray bar dampening system, the dampening fluid is sprayed onto a dampening roller by means of a series of nozzles. The dampening roller then transfers the dampening fluid to the other rollers of the press that are in serial contact with it. Proper and efficient operation of the press requires that the correct amount of dampening fluid be used and that the dampening fluid be applied in a uniform distribution and acceptable pattern. Applying the correct amount of dampening fluid in a uniform distribution and acceptable pattern is particularly difficult when using webs of different widths on a given press.

With regard to the pattern of dampening fluid spray, it is desirable to have the page breaks of the print aligned with the nozzle overlaps. First, because no printing generally occurs at the page breaks, little dampening water is needed in these areas. Second, overlaps in nozzle spray can have the effect of providing inconsistent ink densities on the printing area of the web. Therefore, in order to minimize such inconsistencies, it is desirable to ensure that nozzle spray overlaps occur at page breaks.

Furthermore, when utilizing a conventional spray bar system with a partial web having a relatively narrow width, the extreme outside edges of the spray pattern have no web to remove the dampening fluid. Thus, although the ends of the rollers require a small amount of dampening fluid to lubricate them, the non-web area of the rollers easily become flooded. In order to avoid flooding of the non-web area, attempts have been made to reduce the amount of water supplied by the outer nozzles. Alternatively, the outer nozzles would be turned completely off. Such attempts have been unsuccessful. Because the outer nozzles also supply dampening fluid to a portion of the printing area, there is a corresponding reduction in dampening water supplied to the printing area of the web. This reduction is unacceptable for reliable, quality printing. For example, it may be desirable to operate a newspaper printing press with a double wide web having a width of 55 inches as well as a partial web having a smaller width of 51 inches. Conventional spray bar systems for the double wide web are typically designed using eight nozzles for the four pages of the web. The page breaks coincide with the nozzle overlaps between the second and third nozzle, the fourth and fifth nozzle, and the sixth and seventh nozzle. These page breaks would occur at approximately 13.75 inches, 27.5 inches, and 41.25 inches from one end of the spray bar. Using a newspaper press having a conventional spray bar system to print a partial web of 51 inches, however, causes the page breaks and the nozzle overlaps to become misaligned because each page is 1 inch narrower. Additionally, each edge of the web would have moved towards the center of the press by two inches. These same problems exist when attempting to operate other presses, such as single wide presses and directory presses, with multiple webs of different widths.

Attempts have been made to allow a single spray bar system to be used with webs of different widths. For example, U.S. Pat. No. 5,025,722 to Switall et al. is directed to the adjustment of the positioning of the nozzles, and as such, the spray pattern of a spray bar system. The spray nozzles are laterally movable both towards and away from each other and at the same time, axially movable towards and away from the surface on which the dampening fluid is being applied. In general, the nozzles are mounted on nozzle carriages, each carriage having a follower. The nozzle carriages are axially slidable along a vertical guide track for movement towards and away from the dampening surface. Each follower is positioned in a guideway which restricts each follower's movement to a predetermined path in which they are properly spaced, both laterally and axially. Movement of the followers within the guideways is effected by connecting the followers cam members. The cam members, each having a rack formation, meshingly engage pinion members for allowing the cam members to move relative to each other. With multiple moving parts, however, the disclosed apparatus is complex in design and operation. Thus, manufacture and maintenance of the spray bar can be costly and time-consuming.

3. Objects of the Invention

It is thus an object of the present invention to provide a spray bar for use with webs of different widths.

It is another object of the present invention to provide a spray bar for use with webs of different widths that is simple in operation.

It is another object of the present invention to provide a spray bar for use with the webs of different widths that is easily manufactured.

It is still another object of the present invention to provide a spray bar for use with webs of different widths that is capable of positioning the of nozzles in either of two predetermined configurations.

It is yet another object of the present invention to provide a spray bar for use with webs of different widths that is capable of positioning the nozzle spray overlap in either of two pre-determined configurations.

SUMMARY OF THE INVENTION

To achieve these and other objects, a spray bar according to the present invention for use with webs having different widths comprises a spray bar mounting channel. The spray bar mounting channel has a first end, a second end, a front surface, and at least one cut-out in the front surface. A plurality of reduction plates are affixed to the mounting channel over the cut-outs. In a preferred embodiment, each reduction plate has a center line and an opening therethrough located a predetermined offset from the center line.

DETAILED DESCRIPTION OF THE PREFERRED EMBODIMENTS

Figure 1:
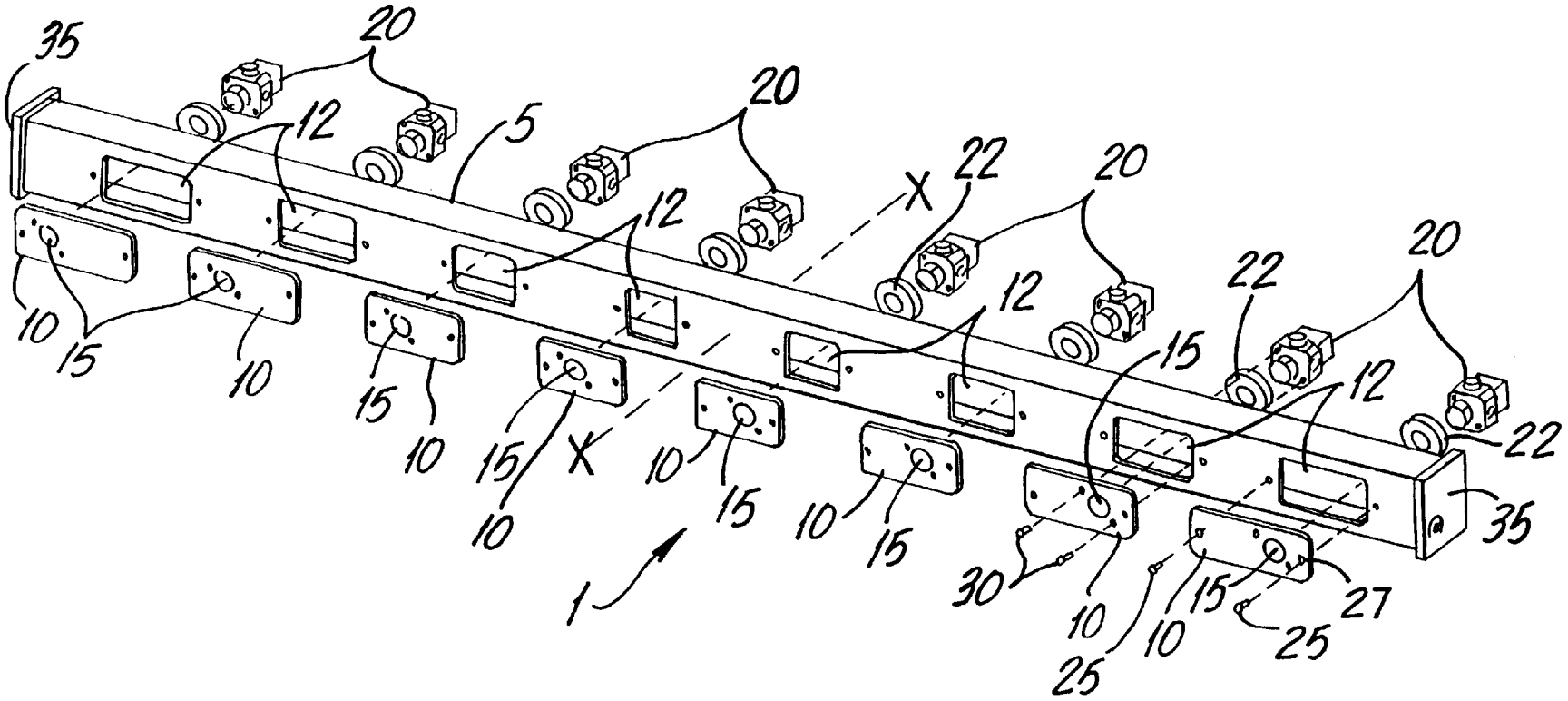
FIG. 1 is a front exploded view of the spray bar of one embodiment of the present invention illustrating the reduction plates and nozzles in a first position.

Certain preferred embodiments of the present invention will now be discussed with reference to the drawings. Turning first to FIG. 1, a spray bar 1 of the present invention is shown with reduction plates 10 and nozzles 20 in a first configuration. The spray bar 1 generally comprises a "U" mounting channel 5 having a plurality of cut-outs 12 along a front surface 8. The reduction plates 10 are releasably mounted on the front surface 8 of the mounting channel 5 such that they cover the cut-outs 12. The reduction plates 10 may be releasably secured to the front surface 8 by any known means. For example, the reduction plates 10 may be provided with a pair of holes 27 for receiving screws 25 for releasably securing the reduction plates 10 to the front surface 8. Regardless of the particular fastener used to secured the reduction plates 10 to the front surface 8 of the mounting channel 5, the reduction plates 10 should be releasably or temporarily mounted in a first configuration.

Each reduction plate 10 is provided with an opening 15. Each opening 15 is offset a predetermined distance from the center of the reduction plate 10. As will be discussed below, the exact positioning of each opening 15 is critical to the proper operation of the spray bar 1. Proper positioning of the opening 15 in each reduction plate 10 is critical because these openings 15 determine the location of nozzles 20.

Each nozzle 20 is positioned inside the "U" mounting channel 5. Moreover, each nozzle 20 is axially aligned with and extends through the opening 15 in a different reduction plate 10. Each nozzle 20 may be secured in place by any suitable means, such as screws 30 that secure the nozzle 20 to the reduction plate 10. Interposed between each nozzle 20 and the corresponding plate 10 is a spacer ring 22. As discussed in greater detail below, the spacer rings 22 ensure that the nozzles 20 are a predetermined distance from the surface of the roller.

Although not shown, each nozzle 20 is connected to a dampening fluid conduit, which in turn is connected to a dampening fluid supply. The use of pumps and manifolds (not shown) in conjunction with the nozzle 20 to produce a spray of dampening fluid is well known in the art.

Figure 2:
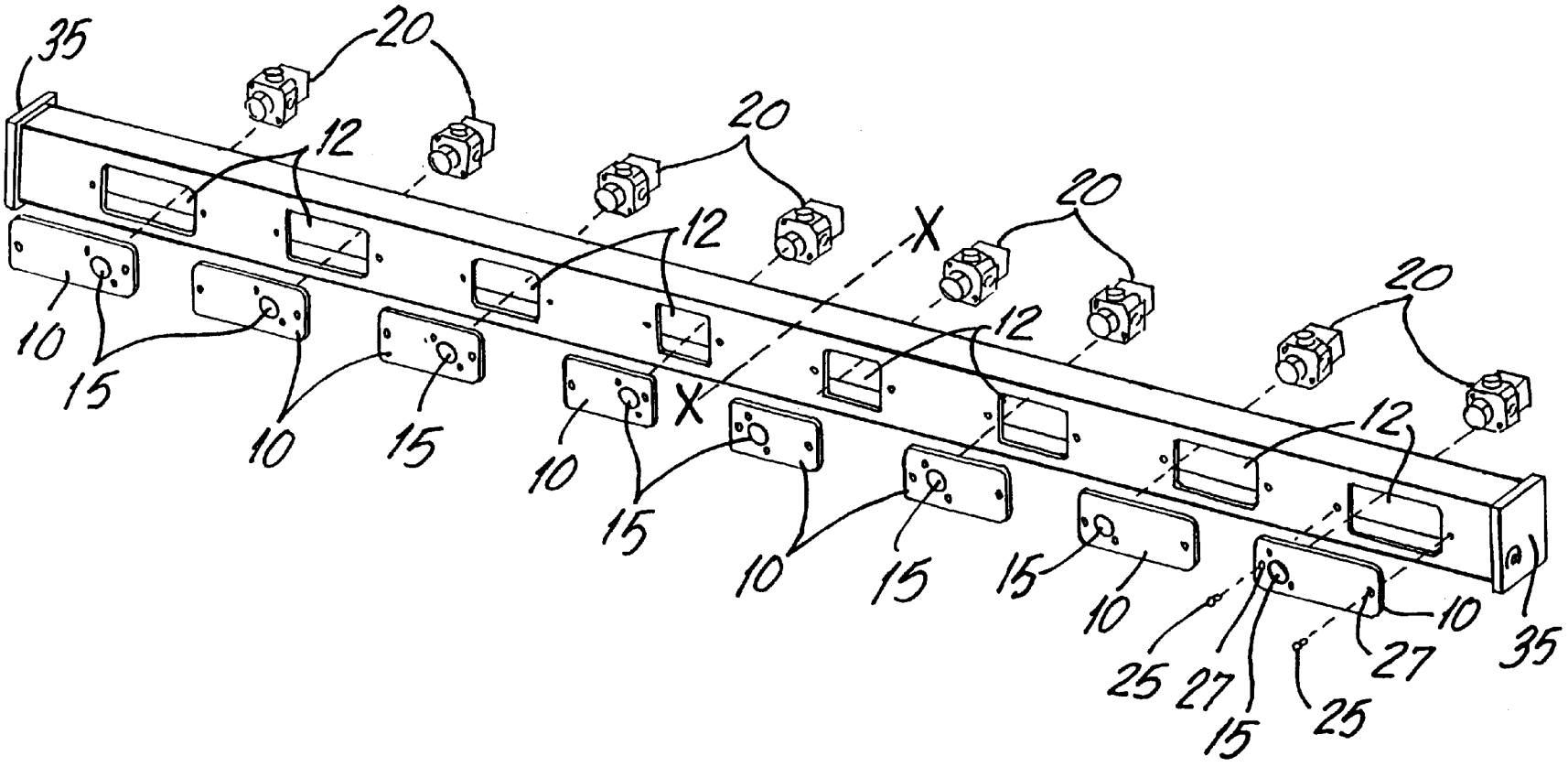
FIG. 2 is a front exploded view of the spray bar illustrating the reduction plates and nozzles in a second position.

As can be seen in FIG. 1 and FIG. 2, the dimensions of each reduction plate 10 need not be identical. This is so because the offsets of the openings 15 vary. In the present embodiment, where the web is centered on the press, however, the spray bar 1 is symmetrical about the center line X indicated in FIG. 1 and FIG. 2.

The spray bar 1 can be positioned adjacent to a dampening roller by any of a number of means, such as mounting the spray bar 1 to a pair of mounting brackets, which in turn, are mounted to a frame of the printing press (not shown). Although not shown, end spray guards may be affixed to either the mounting brackets or each end plate 35 of the spray bar 1. The end spray guards prevent the spray of the two outer-most nozzles from extending beyond the dampening roller and onto the press. Preferably, the end spray guards are adjustably mounted for lateral movement so that the distance between them can be narrowed as the positioning of the nozzles 20 narrow.

Turning now to FIG. 2, there is shown the spray bar 1 with the reduction plates 10 in a second configuration, suitable for use with a second web having a width narrower than that of the first web. It is important to note that the reduction plates 10 used with the second web are the same reduction plates 10 used with the first web. Placement of the reduction plates 10 in the second configuration can be accomplished in different manners. One manner is to remove a given reduction plate 10 from the mounting channel 5, rotate it 180° about its vertical center line, and re-affix it to the mounting channel 5 over the same cut-out 12. Alternatively, a given reduction plate 10 could be removed and switched with its mirror image reduction plate on the opposite side of the center line X of the mounting channel 5. In this manner, each reduction plate 10 need not be symmetrical about its centerline.

Figure 3:
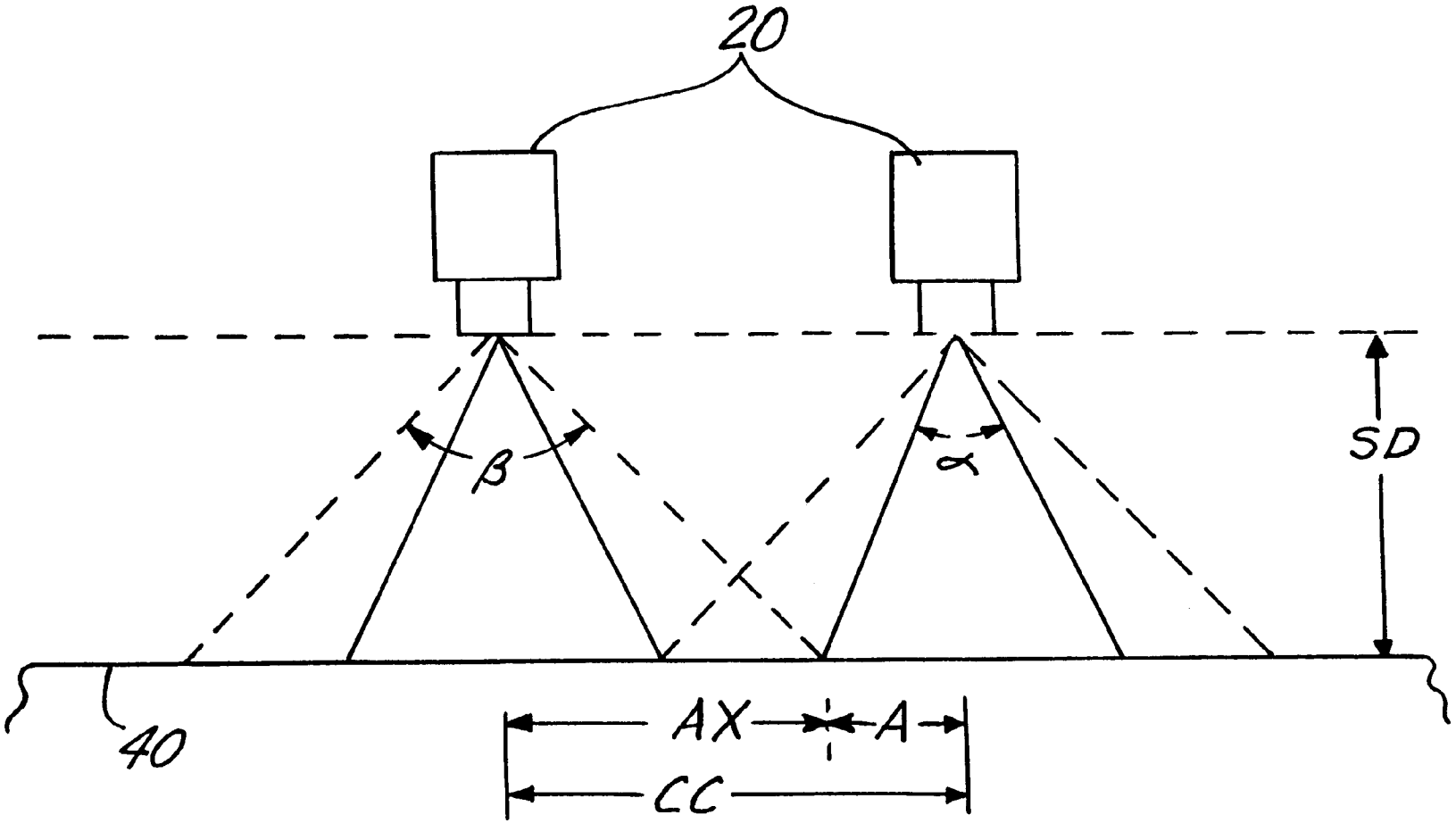
FIG. 3 is an enlarged side view of the spray bar showing nozzles in relation to the surface of a roller on which the nozzles spray.

As noted above, the placement of the nozzles with respect to each other and with respect to the surface on which the dampening fluid is to be applied is critical. When spraying the dampening fluid onto a single roller, the placement of the nozzles can be determined through application of the following equations. As used in the equations, the variables are defined as illustrated in FIG. 3 and as described below:

W=web width

CC=distance between nozzles 20

SD=distance between nozzles 20 and the surface of the dampening roller 40

N=number of nozzles =angle corresponding to 100% spray

β=angle corresponding to a reduced spray, approximately 50% spray in the present embodiment $$CC=A+AX$$

$$W=2*A+(A+AX)*(N-1)$$

$$W=2*A+(CC)*(N-1)$$

$$\text{Tan}\ (\ /2)=A/SD$$

$$\text{Tan}(\beta/2)=AX/SD$$

$$A=SD*\text{Tan}(\ /2)$$

$$AX=SD*\text{Tan}(\beta/2)$$

$$W=2*A+(N-1)*(A+AX)$$

$$W=2*SD*\text{Tan}(\ /2)+(SD*\text{Tan}(\therefore/2)+SD*\text{Tan}(\beta/2))*(N-1)$$

$$W=SD*[2*\text{Tan}(\ /2)+\{\text{Tan}(\ /2)+\text{Tan}(\beta/2)\}*(N-1)]$$

$$SD=W/[2*\text{Tan}(\ /2)+(\text{Tan}(\ /2)+\text{Tan}(\beta/2))*(N-1)]$$

$$CC=A+AX$$

$$CC=SD*\text{Tan}(\ /2)+SD*\text{Tan}(\beta/2)$$

$$CC=SD*[\text{Tan}(\ /2)+\text{Tan}(\beta/2)].$$

Thus, given a nozzle having =82° and β=114°, an eight-nozzle spray bar would have a distance between nozzles (CC) equal to 0.1295*W and a distance between each spray nozzle and the roller (SD) equal to W/18.6028. Consequently, if the spray bar of the present invention was used with a web width of 55 inches, CC would be approximately 7.1225 inches and SD would be approximately 2.9565 inches. Similarly, for a 51 inch wide web, CC could be approximately 6.6045 inches and SD would be approximately 2.7415 inches.

Given the distance between nozzles for each web width, the offset of each opening each reduction plate can be calculated. Numbering the nozzles and corresponding reduction plates consecutively from one end of the bar, the offset of each opening would be determined as follows:

The following definitions will be used when calculating the offsets.

$W_1$=width of the first web to be used on the press;

$W_2$=width of the second web to be used on the press;

N=total number of nozzles on the spray bar;

a=the number of a given reduction plate or nozzle, all reduction plates and nozzles being numbered consecutively from one end of the spray bar;

$CC_1$=distance between nozzles when positioned for use with the first web;

$CC_2$=distance between nozzles when positioned for use with the second web;

$Pa_1$=position of the $a^{th}$ nozzle being used with the first web;

$Pa_2$=position of the $a^{th}$ nozzle being used with the second web;

$O_a$=offset of the opening in the $a^{th}$ reduction plate.

Where both the first and second webs run are centered on the press, the offset of the opening in the first and $N^{th}$ reduction plate is one-half the difference in web widths. In other terms:

$$O_1=\tfrac{1}{2}(W_1-W_2), \text{ and}$$

$$O_N=\tfrac{1}{2}(W_1-W_2), \text{ where } W_1>W_2.$$

For reduction plates two through (N−1), the offset will be equal to one-half the difference between the position of a given nozzle when used with the first web and the position when used with the second web. Because it is the difference in positions that is needed, any reference point may be used for determining a nozzles location. In the following example, the position of the first nozzle when positioned for use with the first web will be the point of reference.

Thus, the position of any given nozzle, other than the first and $N^{th}$, when used with the wider, first web, is equal to the distance between nozzles multiplied by the sum one less than the number of the nozzle. In other terms:

$$Pa_1=(a-1)CC_1=(a-1)7.1225.$$

Calculating the position of the second through $(N-1)^{th}$ nozzles when used with the second, narrower web requires that the initial repositioning of the first nozzle be taken into consideration. Thus, the position of any given nozzle, other than the first and $N^{th}$, is equal to one-half the difference in web widths plus the product of the distance between nozzles multiplied by one less than the number of the given nozzle. In other terms:

$$Pa_2=(W_1-W_2)/2+(a-1)CC_2.$$

The offset of an opening in a given reduction plate is one-half the difference between positions for the nozzle in that reduction plate. In other terms:

$$Oa=\tfrac{1}{2}[Pa_2-Pa_1]=\tfrac{1}{2}[\{(W_1-W_2)/2+(a-1)CC_2\}-\{(a-1)CC_1].$$

In addition to adjusting the lateral positioning of each nozzle, each nozzle's axial position with respect to the surface on which the dampening fluid is to be applied must be adjusted. Thus, the nozzles must be adjustably mounted for movement between a first axial position, $SD_1$, when used with the first web, and a second axial position, $SD_2$, when used with the second web. These distances were calculated above.

As shown in FIGS. 1 and 2, the axial position of the nozzles 20 is adjusted through use of the spacer rings 22. In the present embodiment, each spacer ring 22 has a thickness equal to the difference between $SD_1$ and $SD_2$. Therefore, as shown in FIG. 1, when the spray bar 1 is used with the first web, a spacer ring 22 is positioned between each nozzle 20 and the corresponding reduction plate 10, thereby placing the nozzles a distance $SD_1$ from the roller 40. On the other hand, when the spray bar 1 is used with the second, narrower web, as shown in FIG. 2, the spacer rings 22 are not used. Accordingly, the spray bar is positioned so that without the spacer rings 22 the nozzles 20 are a distance $SD_2$ from the roller 40. In an alternate embodiment, two different sized spacer rings are used, one in connection with the first web and a second in connection with the second web.

When the spray bar 1 is positioned to spray into a nip formed by two rollers rather than on the surface of a single roller, the lateral distance between the nozzles is determined in the same manner as discussed above, namely CC=SD*[Tan( /2)+Tan(β/2)].

Figure 4:
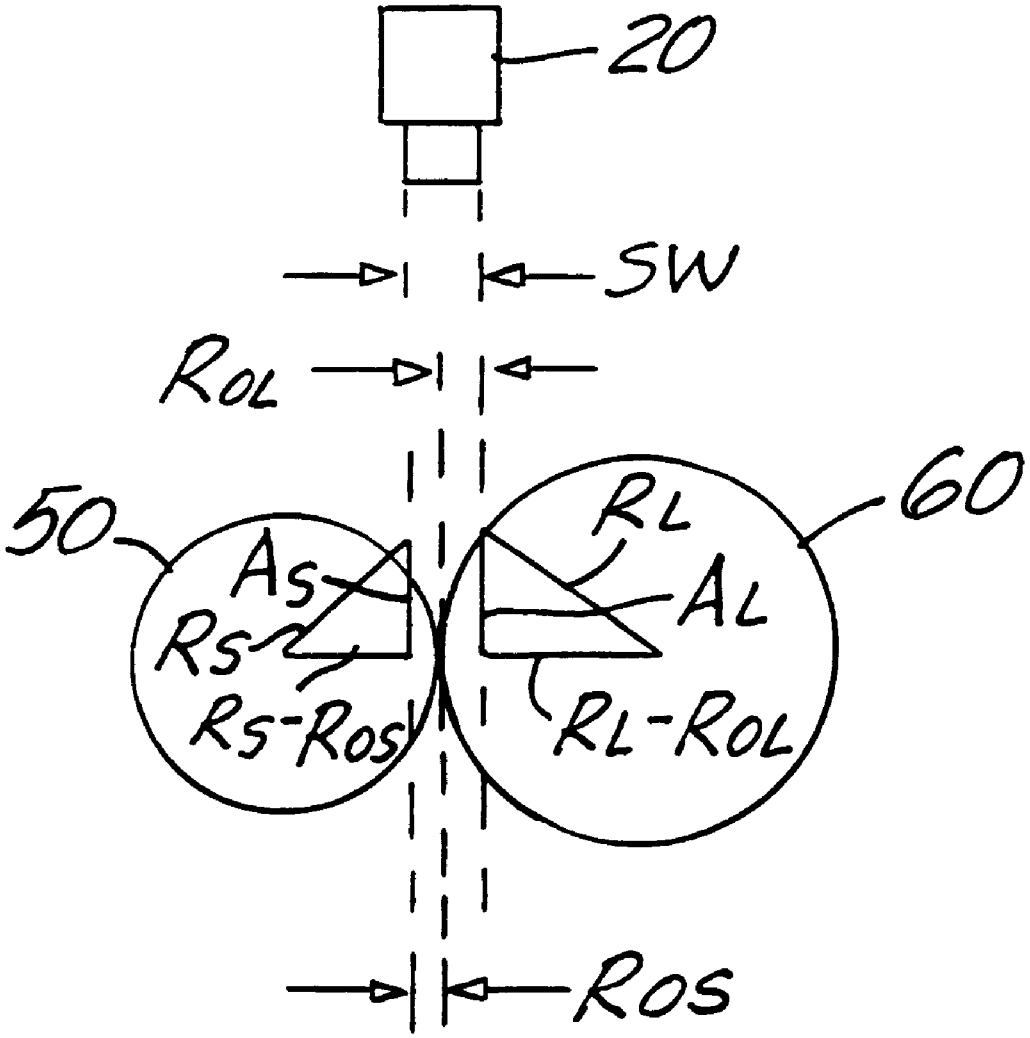
FIG. 4 is an enlarged side view of the spray bar showing a nozzle in relation to a nip into which the nozzle sprays.

Configuration of the spray bar 1 when spraying into a nip will now be described with reference to FIG. 4. As depicted in FIG. 4, the distance from the face of each nozzle 20 to the tangent point of the two rollers 50, 60 that form the nip is equal to SD+A, where SD is defined as above, and A is the average altitude from the tangent point of the two rollers 50, 60 to the point at which the nozzle spray intersects each of the rollers 50, 60. More specifically, $A=(A_S+A_L)/2$, where $A_S$ is the altitude of the smaller roller 50 and $A_L$ is the altitude of the larger roller 60.

Both $A_S$ and $A_L$ can be calculated by applying the pythagorean theorem. Accordingly, $$A_S=[R_S^2-(R_S-R_{OS})^2)]^{1/2},$$

where $R_S$ is the radius of the smaller roller 50 and $R_{OS}$, as indicated in FIG. 4, the fanning of the spray pattern, SW, and the smaller roller 50. More particularly, $$R_{OS}=[R_{OL}/(R_S+R_L)]*SW.$$

Similarly, with respect to the larger roller 60, $$A_L=[R_L^2-(R_L-R_{OL})^2)]^{1/2},$$

where $R_L$ is the radius of the larger roller 60 and $R_{OL}$, as indicated in FIG. 4, the fanning of the spray pattern, SW, and the larger roller 60. Furthermore, $$R_{OL}[R_S+R_L)]*SW.$$

By way of example, where each nozzle of an eight-nozzle spray bar has =82° and β=114°, and where $R_S$ is 40 mm, $R_L$ is 60 mm, and the web width, W, is 55 inches or 1473.2 mm, then SD equals 79.192 mm. Applying the equations noted, $R_{OL}$ equals 4 mm and $R_{OS}$ equals 6 mm. Thus, applying the pythagorean theorem, $A_L$ equals 21.541 mm and As equals 21.071 mm. Knowing each roller's altitude, the average altitude, A, is determined to be 21.3 mm. Therefore, the distance from the face of each nozzle 20 to the tangent line of the two rollers 50, 60, SD+A, equals 100.5 mm.

The distance from the face of each nozzle 20 to the tangent line of the two rollers 50, 60 could similarly be determined when the spray bar 1 is used with a web having a different width. Consequently, when the spray bar 1 is used with a first web, a spacer ring 22 is interposed between each reduction plate 10 and each nozzle 20, as described above.

It is to be understood that a similar method of calculating the offset of a given reduction plate 10 can be applied to other press arrangements, such as when the narrower web runs down a side of a press rather than down the center. In such an embodiment, the position of the first nozzle would change while the spacing between nozzles 20 remains the same. Furthermore, it is within the scope of the present invention to configure the openings 15 in each reduction plate 10 so that not all of the nozzles 20 need to be used at any given time.

It is also to be understood that alternate embodiments of the present invention include other types of reduction plates 10. For example, in one alternate embodiment, the reduction plates 10 are rotatably mounted over each cut-out 12 in the mounting channel 5 by way of a centrally located screw, for example. In another alternate embodiment, each reduction plate 10 is slidably mounted to the mounting channel 5 for movement between positions corresponding to the different nozzle arrangements. In such an embodiment, each reduction plate 10 is slidably mounted to the mounting channel 5 by an upper and a lower flange. The positions of the reduction plates 10 corresponding to the different nozzle positions are dictated by stops, or raised portions on the front surface 8 of the mounting channel 5. Furthermore, other adjustable mounts for the nozzles 20, such as threaded mount, may be employed.

In yet another alternate embodiment, each reduction plate 10 contains two openings 15, each of which corresponds to a different nozzle configuration and location. Thus, rather than reversing the position of each reduction plate 10 when changing web width, each nozzle 20 is merely moved from one opening 15 in the reduction plate 10 to the other opening 15 in the same reduction plate 10.

In another alternate embodiment, the mounting channel 5 includes two sets of cut-outs 12, one for each nozzle configuration corresponding to a different web width. In such an embodiment, each reduction plate 10 is positioned over one cutout 12 when in one configuration and over another cut-out 12 when in another configuration.

As will be appreciated by those skilled in the art, while the relevant distances, as calculated above, provide for optimum placement of the nozzles 20, the distances need not be followed exactly to achieve the aforementioned benefits of the present invention.

While the present invention has been described with reference to particular embodiments, other embodiments that are apparent to those of ordinary skill in the art are also intended to be within the scope of this invention. Accordingly, the scope of this invention is not to be limited to the embodiments disclosed and illustrated herein, but is intended to be limited only by the claims appended hereto.

What is claimed is:

1. A spray bar for use with a first web having a first width and a second web having a second width, there being a difference between the first width and the second width, the spray bar comprising:

a spray bar mounting channel having a first end, a second end, a front surface and at least one cut-out located on said front surface at a predetermined position between said ends;

a plurality of reduction plates, each of said reduction plates having an opening and affixed to said mounting channel and covering said at least one cut-out in either a first or second configuration; and a plurality of nozzles mounted in alignment with said openings, said nozzles mounted in a first position along said front surface for use with the first web when said reduction plates are in said first configuration and mounted in a second position along said front surface for use with the second web when said reduction plates are in said second configuration.

2. The spray bar of claim 1 wherein each reduction plate has a center line and wherein said opening in each reduction plate is located at a predetermined offset from said center line.

3. The spray bar of claim 1 wherein said reduction plates are reversible.

4. The spray bar of claim 1 wherein said reduction plates are rotatable.

5. The spray bar of claim 1 wherein said reduction plates are releasably affixed to said spray bar.

6. The spray bar of claim 2 wherein each of said reduction plates is slidably mounted to said spray bar between a first position, aligning said plurality of nozzles in said first configuration, and a second position, aligning said plurality of nozzles in said second configuration.

7. The spray bar of claim 2 wherein said offset in a given reduction plate is equal to one-half a difference between a first position of a given nozzle aligned with said given reduction plate when said reduction plates are in said first configuration and a second position of said given nozzle aligned with said given reduction plate when said reduction plates are in said second configuration.

8. The spray bar of claim 2 having N number of openings, wherein a first offset of a first opening and an $N^{th}$ offset of an $N^{th}$ opening are equal to one-half the difference in web widths.

9. The spray bar of claim 8 wherein each of said nozzles are positioned a distance CC from an adjacent nozzle, said distance CC being equal to:

$$SD*[\mathrm{Tan}(\ /2)+\mathrm{Tan}(\beta/2)],$$

where  is an angle corresponding to 100% spray and β is an angle corresponding to a reduced spray of one of said nozzles, and SD, a distance between said nozzles and a surface on which said nozzles are to spray, is equal to:

$$W/[2*\mathrm{Tan}(\ /2)+\{\mathrm{Tan}(\ /2)+\mathrm{Tan}(\beta/2)\}*(N-1)],$$

where W is a width of a web to be used.

10. The spray bar of claim 1, wherein said plurality of reduction plates comprises a first plate, a second plate, a third plate, a fourth plate, a fifth plate, a sixth plate, a seventh plate, and an eighth plate, wherein said offset of said first plate and said eighth plate is approximately one-fourth of the difference between web widths, said offset of said second plate and said seventh plate is approximately three-sixteenths of the difference between web widths, said offset of said third plate and said sixth plate is approximately one-eighth of the difference between web widths, and said offset of said fourth plate and said fifth plate is approximately one-sixteenth of the difference between web widths.

11. A spray bar comprising:

a plurality of spray means for producing a spray of fluid;

a plurality of alignment means, each alignment means having an opening therethrough, for aligning one of said spray means;

a mounting means for supporting said alignment means in a one of multiple configurations, said openings being in a first predetermined configuration when said alignment means are in a first configuration, thereby aligning said spray means in a first position and said openings being in a second predetermined configuration when said alignment means are in a second configuration, thereby aligning said spray means in a second position.

12. The spray bar of claim 11 wherein each of said plurality of alignment means comprise a reduction plate in which said opening is located at a predetermined offset from a center line of said reduction plate.

13. A spray bar for use with a first web having a first width and a second web having a second width, the spray bar comprising:

a plurality of means for spraying a fluid;

means for supporting said plurality of spray means; and a plurality of means for aligning in a given direction said plurality of spray means in either of a first configuration associated with the first web or a second configuration associated with the second web.

14. The spray bar of claim 13 further comprising at least one means for aligning in a second direction said plurality of spray means.

15. The spray bar of claim 13 wherein said means for aligning includes a reduction plate having two openings.

16. The spray bar of claim 13 wherein one of said means for aligning is removably affixed to said means for mounting.

17. The spray bar of claim 13 wherein one of said means for aligning is rotatably mounted to said means for mounting.

18. The spray bar of claim 13 wherein said plurality of means for aligning include a plurality of cut-outs in said means for mounting.

19. A spray bar for use with a first web having a first width and a second web having a second width, there being a difference between the first width and the second width, the spray bar comprising:

a spray bar mounting channel having a first end, a second end, a front surface and at least one cut-out located on said front surface at a predetermined position between said ends;

a plurality of reduction plates rotably or reversibly affixed to said mounting channel and covering said at least one cut-out and wherein each reduction plate has an opening at a predetermined location.

20. A spray bar for use with a first web having a first width and a second web having a second width, there being a difference between the first width and the second width, the spray bar comprising:

a spray bar mounting channel having a first end, a second end, a front surface and at least one cut-out located on said front surface at a predetermined position between said ends;

a plurality of reduction plates affixed to said mounting channel in one of multiple configurations and covering said at least one cut-out and wherein each reduction plate has an opening at a predetermined location; and a plurality of nozzles aligned axially with at least some of said openings thereby being in one of multiple positions corresponding to said configurations.

21. The spray bar of claim 20 having N reduction plates, wherein each reduction plate has a center line, said opening in each reduction plate is located at a predetermined offset from said center, and a first offset of a first opening and an $N^{th}$ offset of an $N^{th}$ opening are equal to one-half the difference in web widths.

22. The spray bar of claim 20 wherein in said positions each of said nozzles is positioned a distance CC from an adjacent nozzle, said distance CC being equal to:

$$SD*[\mathrm{Tan}(\ /2)+\mathrm{Tan}(\beta/2)],$$

where  is an angle corresponding to 100% spray and β is an angle corresponding to a reduced spray of one of said nozzles, and SD, a distance between said nozzles and a surface on which said nozzles are to spray, is equal to:

$$W/[2*\mathrm{Tan}(\ /2)+\{\mathrm{Tan}(\ /2)+\mathrm{Tan}(\beta/2)\}*(N-1)],$$

where W is a width of a web to be used.

23. The spray bar of claim 21, wherein said plurality of reduction plates comprises a first plate, a second plate, a third plate, a fourth plate, a fifth plate, a sixth plate, a seventh plate, and an eighth plate, wherein said offset of said first plate and said eighth plate is approximately one-fourth of the difference between web widths, said offset of said second plate and said seventh plate is approximately three-sixteenths of the difference between web widths, said offset of said third plate and said sixth plate is approximately one-eighth of the difference between web widths, and said offset of said fourth plate and said fifth plate is approximately one-sixteenth of the difference between web widths.

24. The spray bar of claim 20 wherein at least one of said reduction plates has two openings.

* * * * *